US007338132B2

(12) United States Patent
LaPointe

(10) Patent No.: US 7,338,132 B2
(45) Date of Patent: Mar. 4, 2008

(54) MULTIPLE POSITION LEG REST MECHANISM

(75) Inventor: Larry P LaPointe, Temperance, MI (US)

(73) Assignee: La-Z-Boy Incorporated, Monroe, MI (US)

( * ) Notice: Subject to any disclaimer, the term of this patent is extended or adjusted under 35 U.S.C. 154(b) by 269 days.

(21) Appl. No.: 11/205,202

(22) Filed: Aug. 16, 2005

(65) Prior Publication Data

US 2007/0040439 A1 Feb. 22, 2007

(51) Int. Cl.
*A61G 15/00* (2006.01)
*A47C 7/50* (2006.01)
*A47C 20/00* (2006.01)

(52) U.S. Cl. ..... 297/423.26; 297/69; 297/423.3

(58) Field of Classification Search ..... 297/423.26, 297/69, 432.3, 423.3
See application file for complete search history.

(56) References Cited

U.S. PATENT DOCUMENTS 3,325,210 A * 6/1967 Knabusch et al. ..... 297/269.1
4,367,895 A 1/1983 Pacitti et al.
5,328,235 A * 7/1994 Saul et al. ..... 297/270.1
5,427,431 A * 6/1995 Saul et al. ..... 297/85
5,570,927 A 11/1996 LaPointe et al.
6,655,732 B1 * 12/2003 LaPointe ..... 297/85

* cited by examiner

*Primary Examiner*—George B. Nguyen
*Assistant Examiner*—Kaitlin A Wilson
(74) *Attorney, Agent, or Firm*—Harness, Dickey & Pierce, P.L.C.

(57) ABSTRACT

A three-position leg rest mechanism includes a link and sector members rotatably supported to the link. The sector members are coupled to a drive rod for rotation therewith. A biased pin engages the sector members and releasably locks with the sector members in each of three positions. A locking link end opposite the sector members is coupled to a support shaft of the actuation mechanism. An elastically compressible member is positioned between the sector members which is partially compressed by the pin as the pin moves relative to the sector members, reducing contact noise between the pin and the sector members.

33 Claims, 12 Drawing Sheets

MULTIPLE POSITION LEG REST MECHANISM

FIELD OF THE INVENTION

The present invention relates in general to furniture members and more specifically to a device and method for operating a furniture member leg rest.

BACKGROUND OF THE INVENTION

Traditionally, furniture members such as reclining chairs are equipped with an actuation mechanism which is operatively interconnected between a prefabricated chair frame and a stationary base assembly. The actuation mechanism is typically a combination of various mechanical linkages operable for providing various comfort features such as independent reclining movement of a seat assembly as well as actuation of an extensible leg rest assembly and associated tilting of the chair frame.

While many conventional reclining chairs operate satisfactorily, furniture manufacturers are continually striving to develop improved frames and actuation mechanisms for reducing system complexity and smoothness of operation as well as occupant comfort. Furthermore, there is a continuing desire to develop improved fabrication and assembly techniques which will result in reduced costs while promoting increased efficiency and improved product quality.

In conventional actuation mechanisms, a lubricant is commonly used to reduce friction between mechanism components. Due to the limited accessibility of the mechanism components after installation and during subsequent consumer use, continued application of the lubricant is difficult to ensure. Increased mechanism noise and undue wear can therefore result. Components that require no lubrication are therefore desirable.

SUMMARY OF THE INVENTION

According to one preferred aspect for a multiple position leg rest mechanism of the present invention, an actuation mechanism includes a drive rod and a front support shaft. A leg rest mechanism for releasably positioning a leg rest in each of a retracted position, an extended position, and at least one intermediate position, the leg rest mechanism includes a pair of sector plates coupled to the drive rod for co-rotation therewith. Each of the sector plates has a peripheral edge. An elastically compressible element is interposed between the sector plates. A biased pin slidably engages the peripheral edge of the sector plates. A biasing element biases the pin into engagement with the peripheral edge. The pin partially elastically compresses the compressible element during engagement of the pin with the peripheral edge of the sector plates.

According to another aspect of the invention, a furniture member leg rest mechanism includes a rotatable, rectangular-shaped drive rod. A leg rest assembly is coupled to the drive rod for extension by rotation of the drive rod. A spring assisted toggle assembly biases the leg rest assembly in each of a retracted position and a fully extended position. A pair of sector plates couple to the drive rod for co-rotation therewith, each of the sector plates having a peripheral edge including at least one recess. An elastically compressible element is interposed between the sector plates and extends beyond the peripheral edge of the sector plates. A pin extends through the sector plates and slidably engages the peripheral edge of the sector plates. A biasing element biases the pin into engagement within the recess created in the peripheral edge. The pin elastically compresses the compressible element during engagement of the pin with the peripheral edge of the sector plates.

According to still another aspect, a method for operating a furniture member leg rest mechanism includes interposing the compressible element between the sector plates. The sector plates and the compressible element are coupled to the drive rod for co-rotation therewith. The pin is biased into engagement with the peripheral edge using the biasing element. The drive rod is rotated. The pin is slidably engaged with the peripheral edge of the sector plates to elastically compress the compressible element.

A multiple position leg rest mechanism of the present invention provides several advantages. By positioning a compressible material element between sector plates that control a leg rest assembly rotation position, a pin engages the compressible material element and limits the noise generated when locked positions of the mechanism are reached. The compressible material element also eliminates a need for lubricant which would be required if the pin and the sector plates are both made of metal. The sector plates can also be made of a polymeric material, further reducing the noise of the mechanism. Biasing elements ensure the pin continuously contacts the peripheral edge of the sector plates, which also therefore ensure the pin engages in recesses of the sector plates positioned to provide locked positions of a leg rest assembly.

Further areas of applicability of the present invention will become apparent from the detailed description provided hereinafter. It should be understood that the detailed description and specific examples, while indicating several preferred aspects of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION

The following description of several aspects of the invention is merely exemplary in nature and is in no way intended to limit the invention, its application, or uses.

In accordance with the teachings of the present invention, a multiple position leg rest mechanism for use in single and multi-person articles of furniture (i.e.: chairs, sofas and/or loveseats) is disclosed. A general understanding of the art to which the present invention pertains is disclosed in U.S. Pat. No. 3,325,210, Adjustable Leg Rest Locking Device, U.S. Pat. No. 5,570,927, Modular Wall Proximity Reclining Chair, and U.S. Pat. No. 6,655,732, Multiple Position Leg Rest Mechanism For A Reclining Chair, which are commonly owned by the assignee of the present invention and the disclosure of which is expressly incorporated by reference herein. As will be described, the pre-assembled actuation mechanism is uniquely suspended in a "fixed" pivot-point arrangement from pre-upholstered box-like frame components so as to provide precise mechanical alignment and superior structural rigidity while concomitantly facilitating application of highly efficient fabrication and assembly processes.

Figure 1:
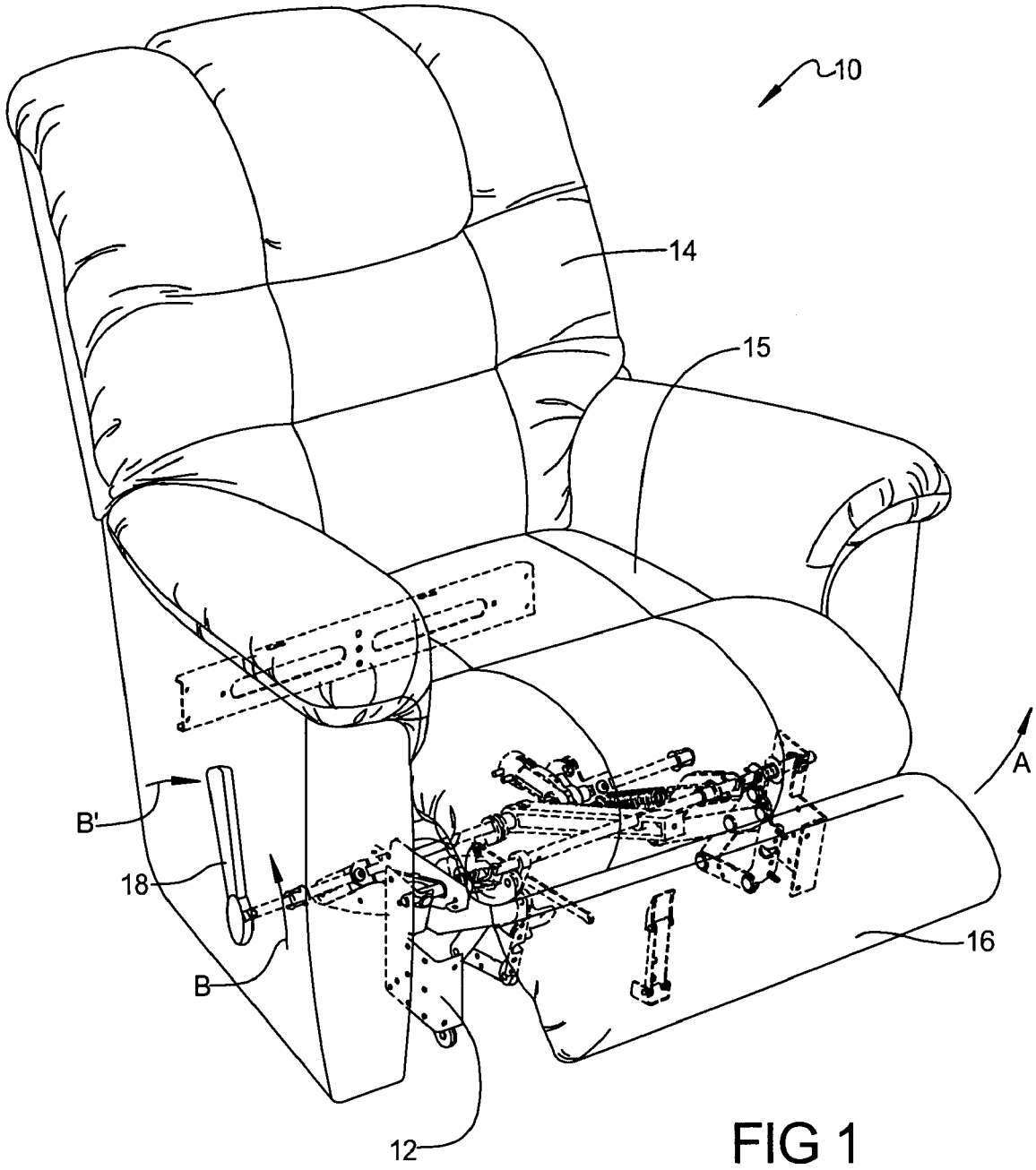
FIG. 1 is a perspective view of a chair having a multiple leg rest position mechanism of the present invention.

With reference to FIG. 1, the article of furniture shown is a combination wall proximity recliner and tilt chair, hereinafter referred to as chair 10. Chair 10 includes an actuation mechanism 12 and various upholstered frame components that can be quickly and simply assembled as a modular seating unit. It should also be understood, however, that the elements of actuation mechanism 12 are not limited to use with chair 10, but are applicable for use in virtually any type of single or multi-person article of furniture. As such, the particular structure of the various sub-assemblies and components which, when assembled, define chair 10 are merely intended to illustrate but one furniture application to which the present invention is applicable.

As further shown in reference to FIG. 1, a seat back 14 can be rotated with respect to a seat support assembly 15. A leg rest assembly 16 is extensible in an arc A from a stowed position abutting chair 10 to an extended position using a hand lever 18. In one aspect of the invention, hand lever 18 is rotated counterclockwise about an arc B to extend leg rest assembly 16, and rotated clockwise about an arc B' to return leg rest assembly 16 from the extended to the stowed position.

Figure 2:
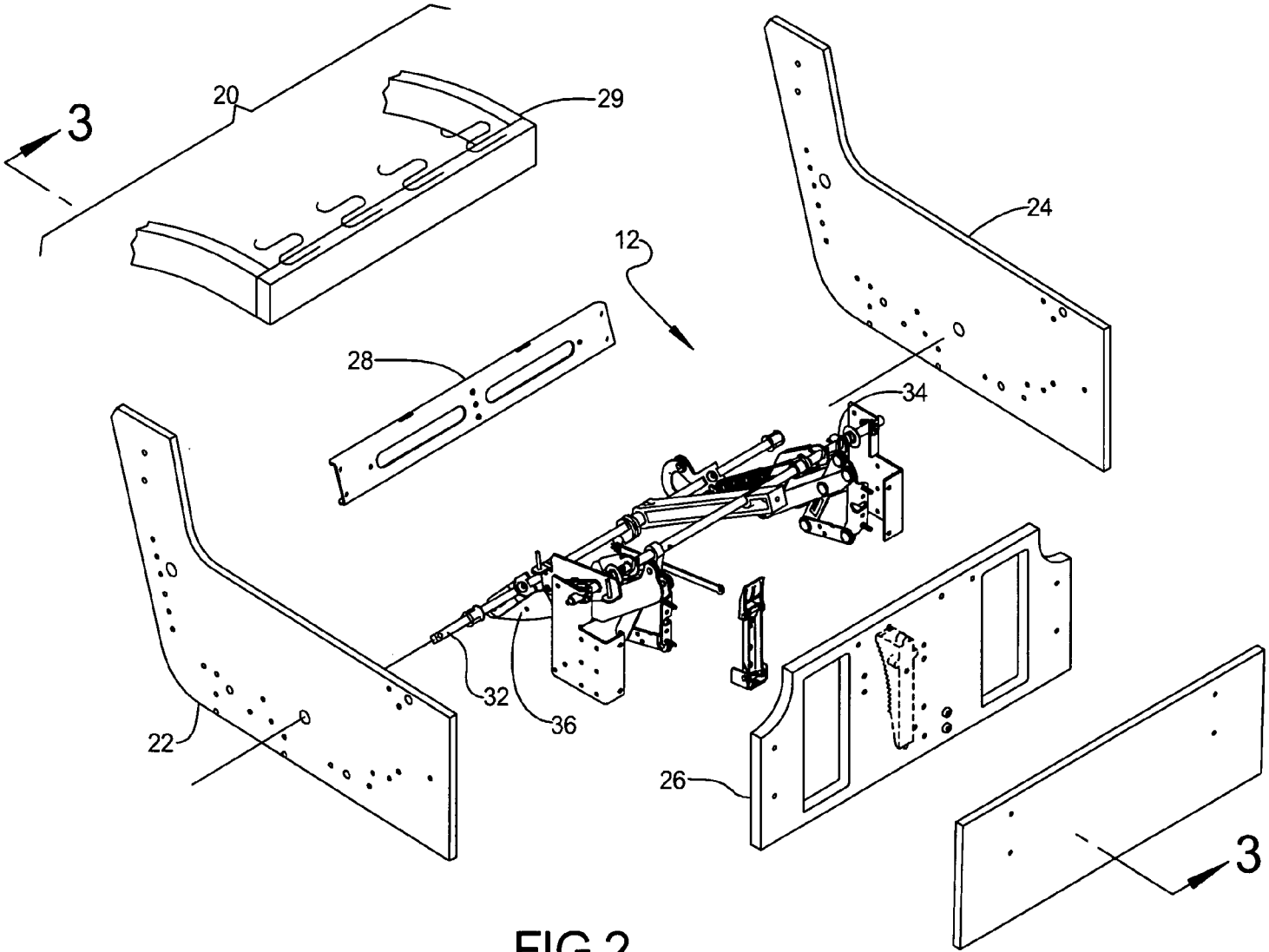
FIG. 2 is an exploded perspective assembly view of the frame and mechanism components for chair of FIG. 1.

Referring now generally to FIG. 2, the various frame components are shown in exploded view with upholstery, padding, springs, etc. removed to better illustrate the interdependency of the frame components construction which can be rapidly and rigidly assembled in a relative easy and efficient manner. As such, all of the frame components can be individually fabricated or sub-assembled to include the requisite brackets, springs, padding and upholstery on an "off-line" batch-type basis. Thereafter, the various pre-assembled and upholstered frame components are assembled for totally integrating actuation mechanism 12 therein.

As best seen in FIG. 2, actuation mechanism 12 is integrated into and operably suspended from a chair frame 20 and, in particular, from left and right side frame assemblies 22, 24. In addition to side frame assemblies 22, 24, chair frame 20 also includes a front rail assembly 26 and a rear rail 28 which, when interconnected, connect to a rigid "box-like" chair frame 29. In general, the structural frame components such as side frame assemblies 22, 24, front rail assembly 26, and rear rail 28, are each constructed in a manner which enables them to support springs, padding, upholstery, and the like in order to complete a decorative and stylish chair 10. Each frame component is individually preassembled for subsequent modular assembly into chair 10. However, it is to be understood that the specific construction shown for each frame component is merely exemplary in nature.

Figure 3:
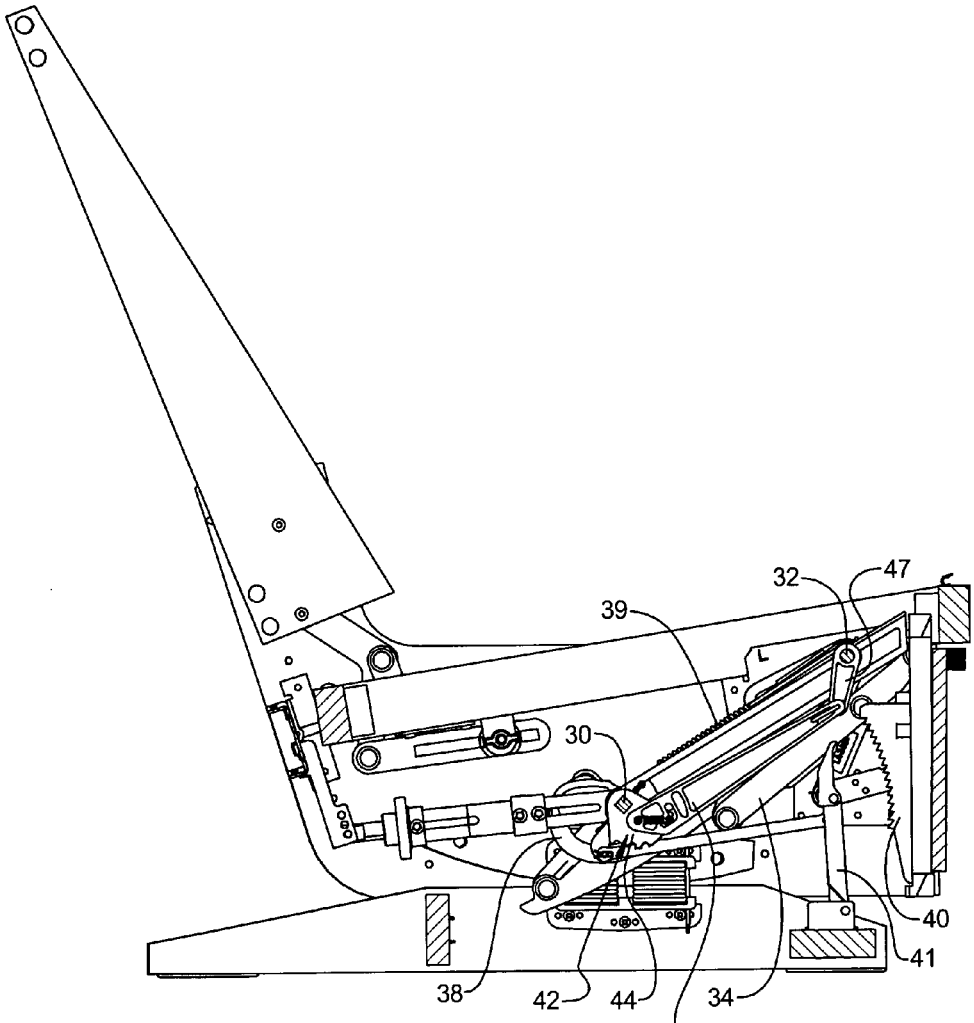
FIG. 3 is a cross sectional side elevational view taken at section 3-3 of FIG. 2.

With reference to FIGS. 2 and 3, actuation mechanism 12 includes a drive rod 30 and front support shaft 32, both of which are spatially oriented to be located and "suspended" from left and right side frame assemblies 22, 24. In some aspects, drive rod 30 is an elongated square-shaped metal shaft having manually-operable hand lever 18 (shown in FIG. 1) secured thereto adjacent an upholstered exterior portion of one of side frame assemblies 22 or 24. Hand lever 18 can therefore be easily reached by a person seated in chair 10 for convenient actuation of drive rod 30. Leg rest assembly 16 as shown in FIG. 1 is supported for extensible movement using actuation mechanism 12. More specifically, leg rest assembly 16 includes a left and a right pantograph linkage 34, 36 and a spring-assisted toggle assembly 38 which are operably associated with drive rod 30 and front support shaft 32 for permitting the seat occupant to selectively actuate leg rest assembly 16 in response to rotation of drive rod 30 via hand lever 18.

Leg rest assembly 16 is both supported and moved by left and right hand pantograph linkages 34, 36. In some aspects of the invention, left and right hand pantograph linkages 34, 36 are identical. Pantograph linkages 34, 36 are operably suspended about a set of "fixed" suspension points defined by front support shaft 32. The extensible action of leg rest assembly 16 takes place simultaneously for both the left hand and right hand pantograph linkages 34, 36 when there is sufficient angular rotation of drive rod 30 via hand lever 18. With specific reference to FIG. 3, an exemplary construction for a spring-assisted toggle assembly 38 is shown which works coactively with leg rest pantograph linkages 34, 36 for biasing and securely holding leg rest assembly 16 in the fully retracted or stowed position against front rail assembly 26. Toggle assembly 38 also provides a biasing element 39 such as a spring operable to create a biasing force for biasingly urging leg rest assembly 16 toward any of its extended positions.

Figure 4:
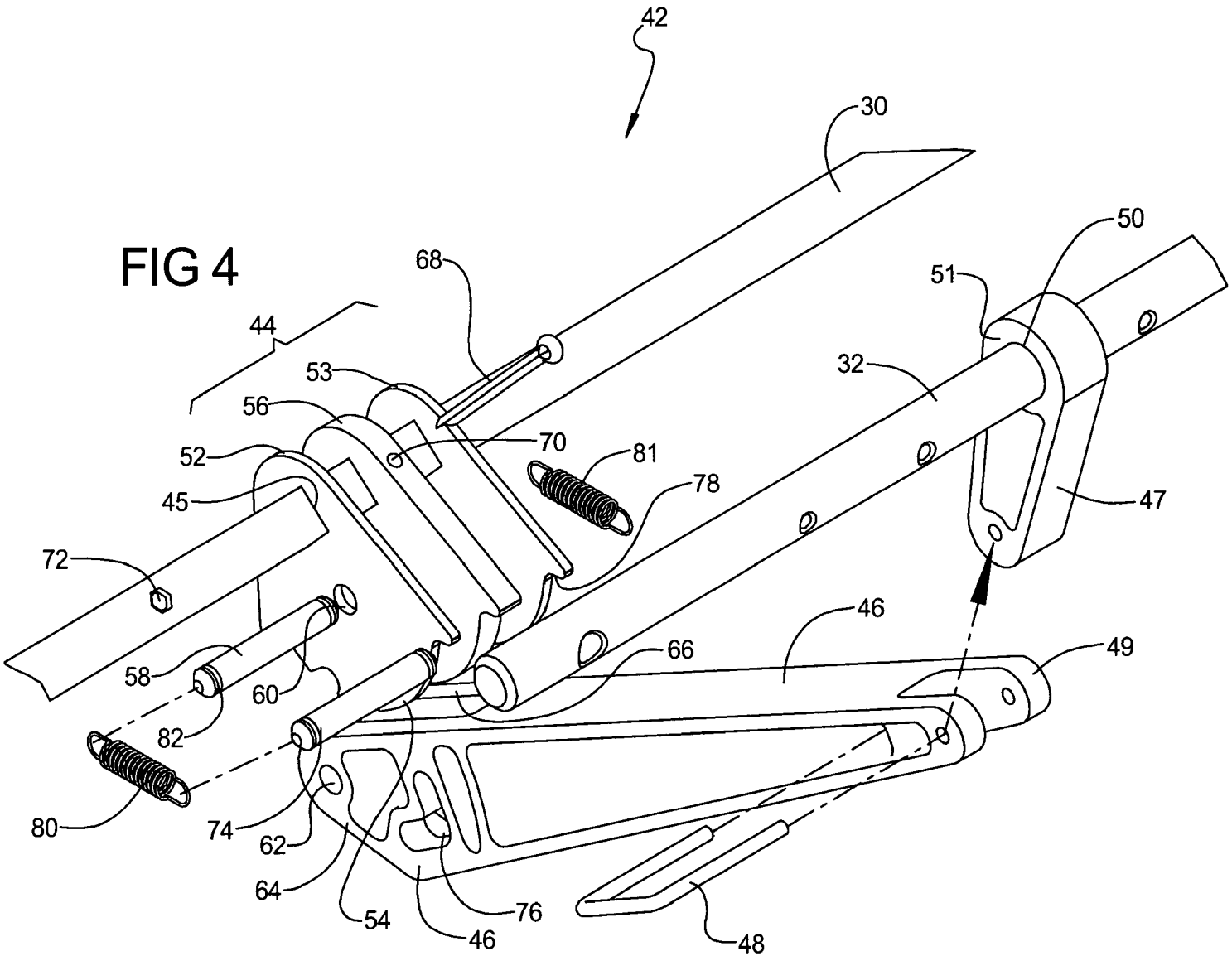
FIG. 4 is an exploded perspective assembly view of a detent mechanism of the present invention.
Figure 5B:
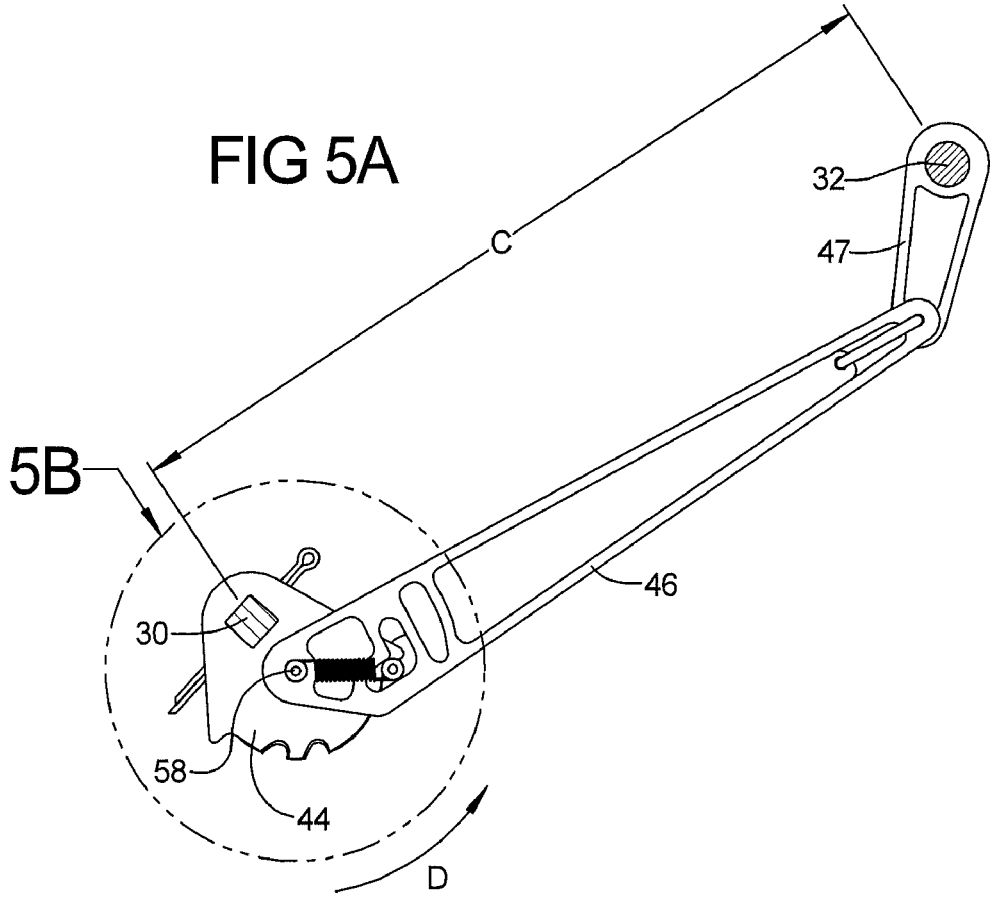
FIG. 5 is a side elevational view of an assembled detent mechanism of the present invention.
Figure 5B:
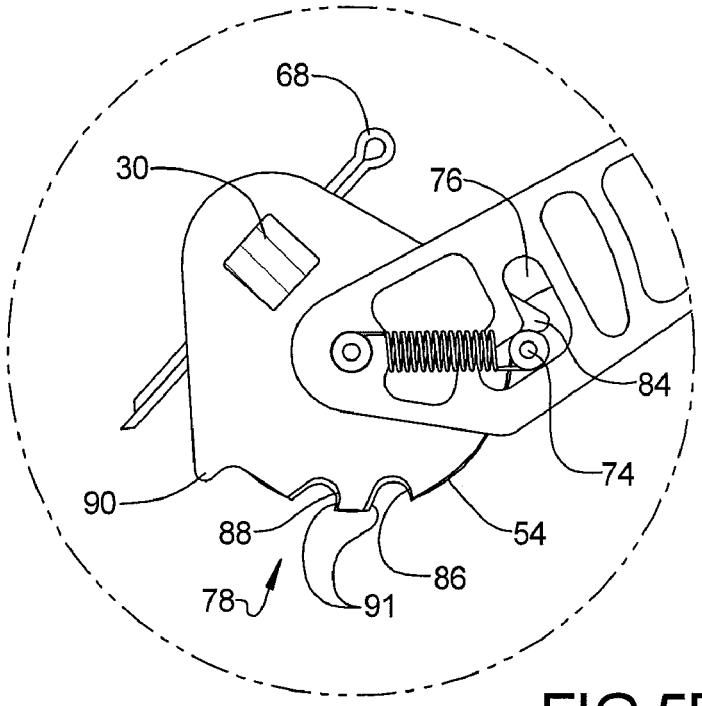
Figure 6:
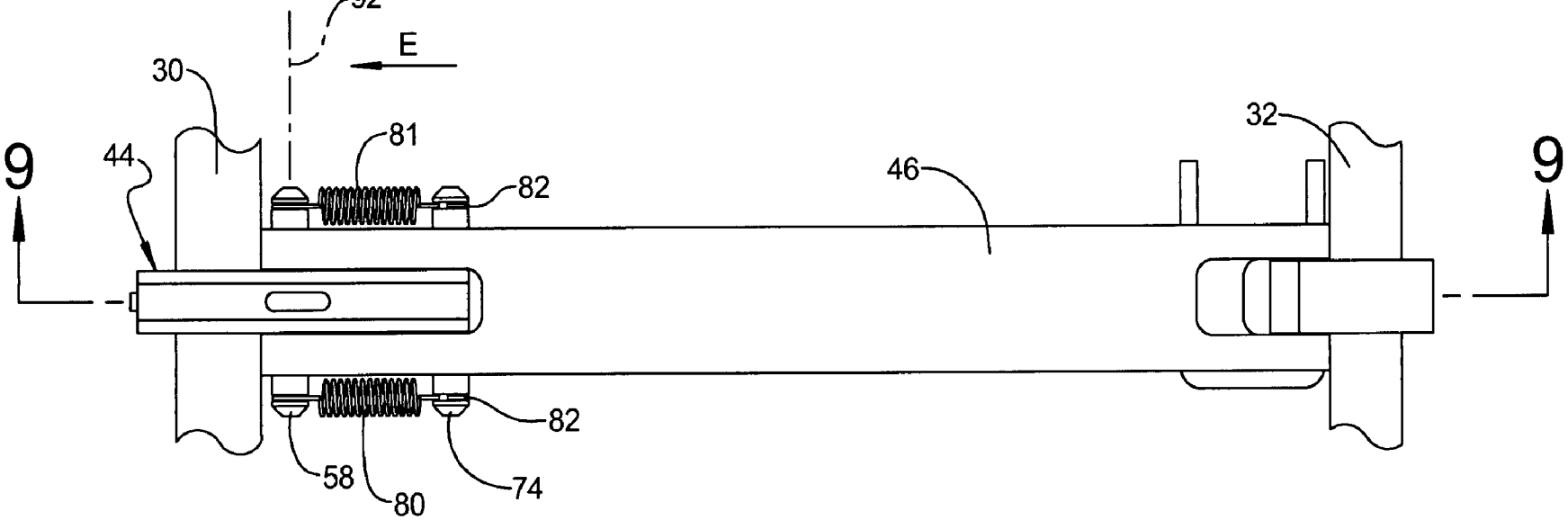
FIG. 6 is a top plan view of the detent mechanism of FIG. 5.
Figure 7:
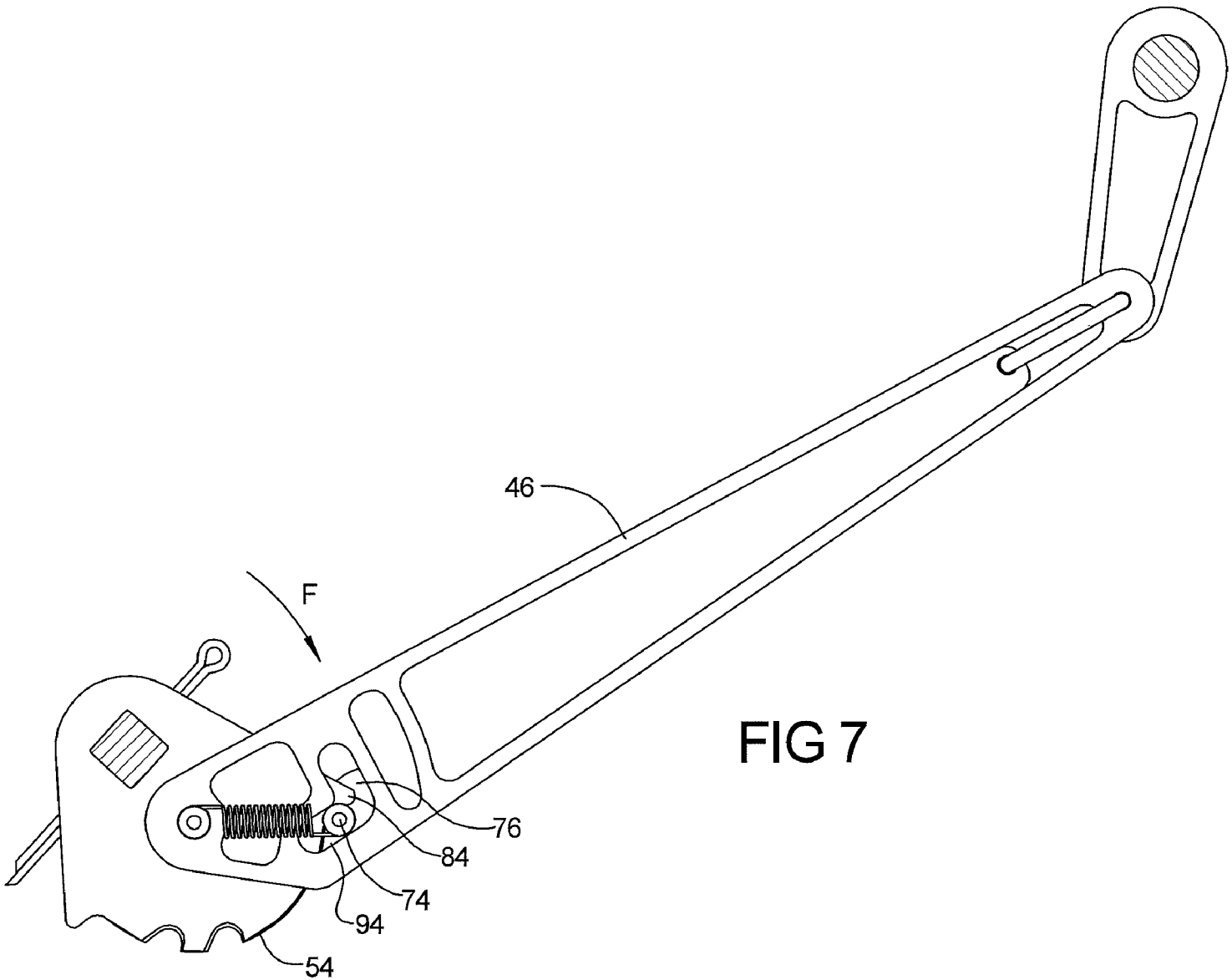
FIG. 7 is a side elevational view of a leg rest stowed rotational stop position of the detent mechanism of FIG. 5.
Figure 8:
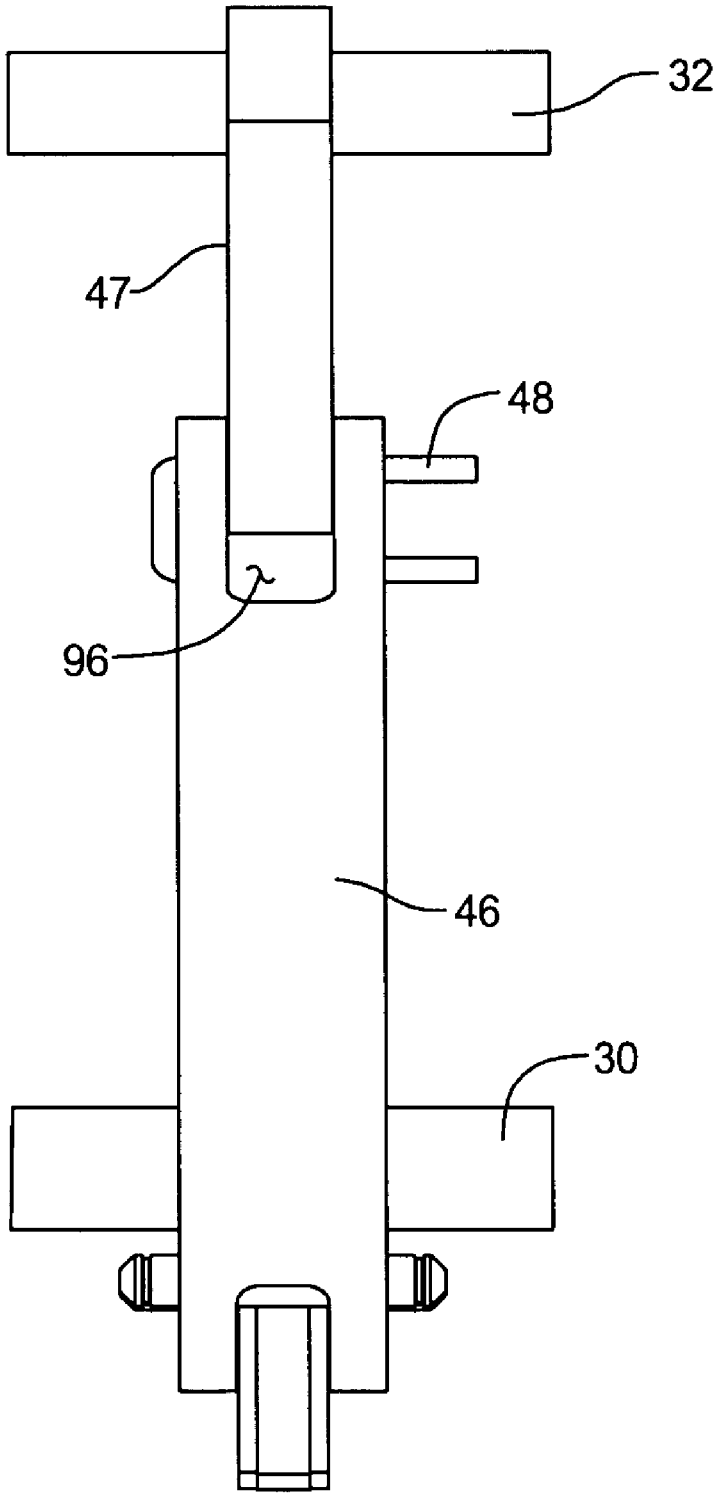
FIG. 8 is a top plan view of the detent mechanism of FIG. 7.
Figure 9:
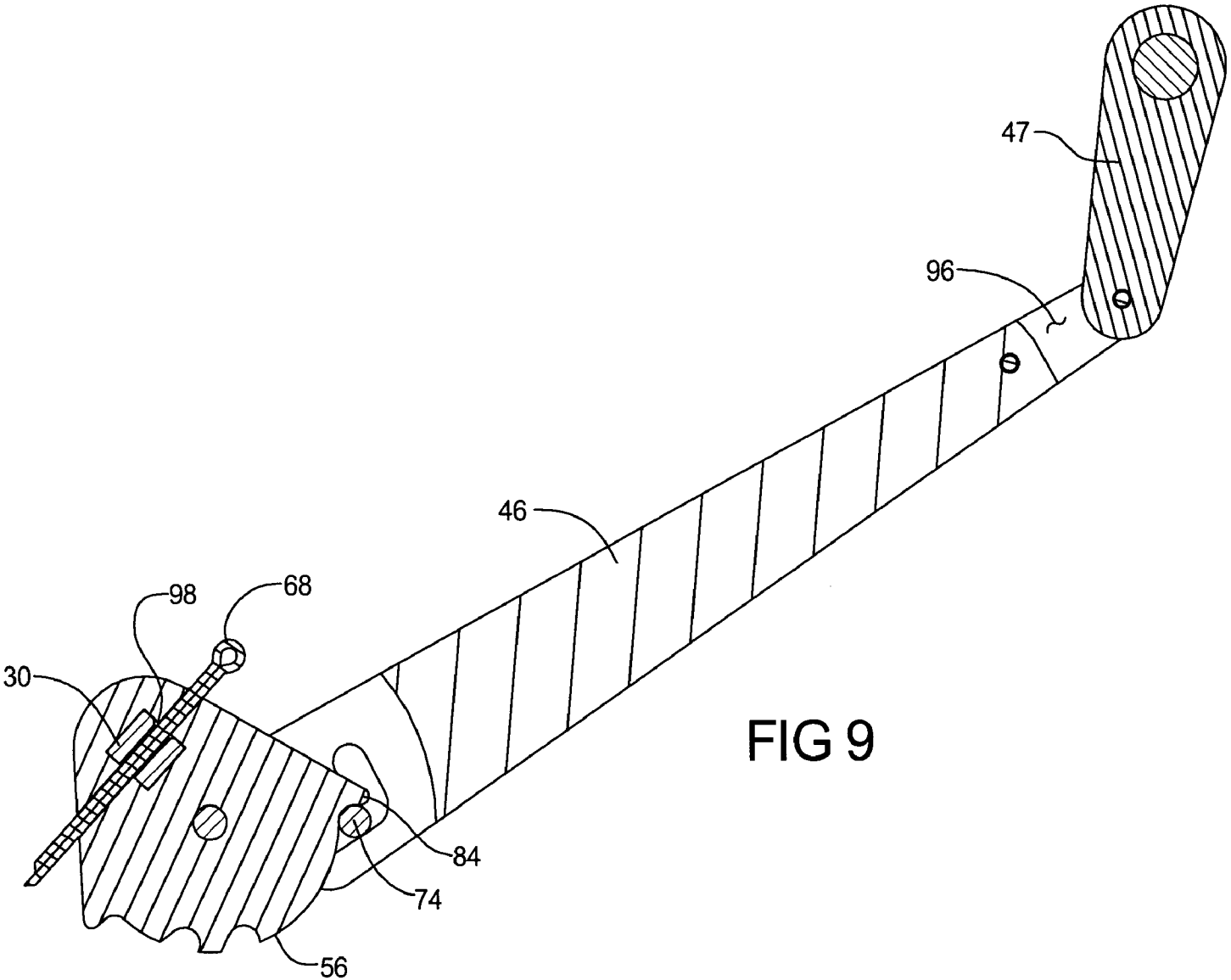
FIG. 9 is a cross sectional side elevational view of the detent mechanism taken at section 9-9 of FIG. 6.

According to the representative aspect shown in FIGS. 4 and 5, a ratchet 40 and a pawl assembly 41 allow chair 10 to be locked in a plurality of reclined/tilted positions. A detent mechanism 42 is also provided to interconnect drive rod 30 and front support shaft 32 for providing various "locked positions" for leg rest assembly 16 between its "stowed" (or retracted) and its "extended" positions. Generally, detent mechanism 42 provides a stowed position and three distinct locking positions for leg rest assembly 16 that are established independent of the reclined/tilted position of seat back 14 or seat support assembly 15 of chair 10. Locking positions as defined herein refer to individual, releasable positions of leg rest assembly 16 which are temporarily provided by detent mechanism 42 and retained until acted on such as by rotating hand lever 18 to change to another position.

With continuing reference to FIGS. 4 through 5, detent mechanism 42 includes a sector assembly 44 having a square-shaped aperture 45 formed therethrough which slidably receives drive rod 30 and rotates in response to rotation of drive rod 30. An incline link 46 extends generally between sector assembly 44 and a link connector 47. Link connector 47 is rotatably pinned by a U-shaped pin 48 through apertures at a first end 49 of incline link 46. Connection between link connector 47 and support shaft 32 is made by sliding support shaft 32 through an aperture 50 created through a second end 51 of link connector 47.

Sector assembly 44 includes a pair of sector plates 52, 53 each having an arcuate peripheral edge 54. In one aspect, sector plates 52, 53 are also provided of a polymeric or composite material. In another aspect, sector plates 52, 53 are created of a metal material such as steel or aluminum. Sector assembly 44 further includes a compressible element 56 interposed between the pair of sector plates 52, 53. In one aspect, compressible element 56 is provided of a polymeric or rubber material. A pivot pin 58 extends sequentially through: an aperture 60 created in sector plate 52; an aperture 62 of a first extending leg 64 of incline link 46; an aperture (not visible) in compressible element 56; another aperture (not visible) in a second extending leg 66 of incline link 46; and another aperture 60 created in sector plate 53. Sector assembly 44 is slidably positioned on drive rod 30 and pinned in place using a fastener 68 such as a expandable pin pressed through an aperture 70 of compressible element 56 and one of a plurality of receiving apertures 72 created in drive rod 30.

A pin 74 is slidably received in an L-shaped aperture 76 created in each of first and second extending legs 64 and 66. Pin 74 engages each of a plurality of cam areas 78 created on sector plates 52, 53 and compressible element 56. Pin 74 is biased toward pivot pin 58 using a pair of biasing elements 80, 81 such as extension springs seated in rings 82 created proximate to ends of each of pivot pin 58 and pin 74.

Referring now to FIGS. 5A and 5B, the cam areas of each of sector plates 52, 53 and compressible element 56 created in arcuate peripheral edge 54 define a first cam 84, a pair of locking recesses 86, 88, a second cam 90. The stowed position of actuation mechanism 12 is represented in FIGS. 5A and 5B. As sector assembly 44 rotates from the stowed position shown, pin 74 releases from temporary contact with first cam 84 and can temporarily releasably engage in each of locking recesses 86, 88 to establish first and second temporary locking positions of leg rest assembly 16. Further rotation of sector assembly 44 releases pin 74 from locking recess 88 and a fully extended position of leg rest assembly 16 is reached when pin 74 releasably engages second cam 90. A fixed spacing C is provided between drive rod 30 and support shaft 32. Rotation of sector assembly 44 therefore requires angular displacement of both incline link 46 and link connector 47 relative to a rotational axis or longitudinal centerline of pivot pin 58. Pin 74 is also permitted by biasing elements 80, 81 to follow the contour of cam areas 78 as sector assembly 44 rotates in an arc D in response to rotation of drive rod 30.

The use of polymeric material for each of sector plates 52, 53 and compressible element 56 reduces a "ratcheting noise" as pin 74 engages each of locking recesses 86, 88, or second cam 90. It is desirable if sector plates 52, 53 are provided of a non-polymeric or non-rubber material that compressible element 56 extend outwardly beyond peripheral edge 54, forming a standout portion 91, to permit compressible element 56 to absorb the contact force as pin 74 engages locking recesses 86, 88, or second cam 90 of sector plates 52, 53.

As best seen in reference to FIGS. 6 through 9, when assembled, incline link 46 is supported for rotation about pivot pin 58 on an axis of rotation 92 through sector assembly 44. Biasing elements 80, 81 bias pin 74 toward pivot pin 58 in direction E. Pin 74 is in contact with first cam 84 and is substantially positioned within a first leg 94 of L-shaped aperture 76. Further rotation of sector assembly 44 about an arc F is prevented by the combination of first leg 94 and first cam 84. Contact with compressible element 56 advantageously reduces friction between pin 74 and peripheral edge 54, which eliminates the need for a lubricant between pin 74 and peripheral edge 54. A clearance opening 96 between incline link 46 and link connector 47 allows rotation of incline link 46 relative to link connector 47 about U-shaped pin 48. An aperture 98 through drive rod 30 is clearly visible in FIG. 9 for receiving fastener 68.

Figure 10:
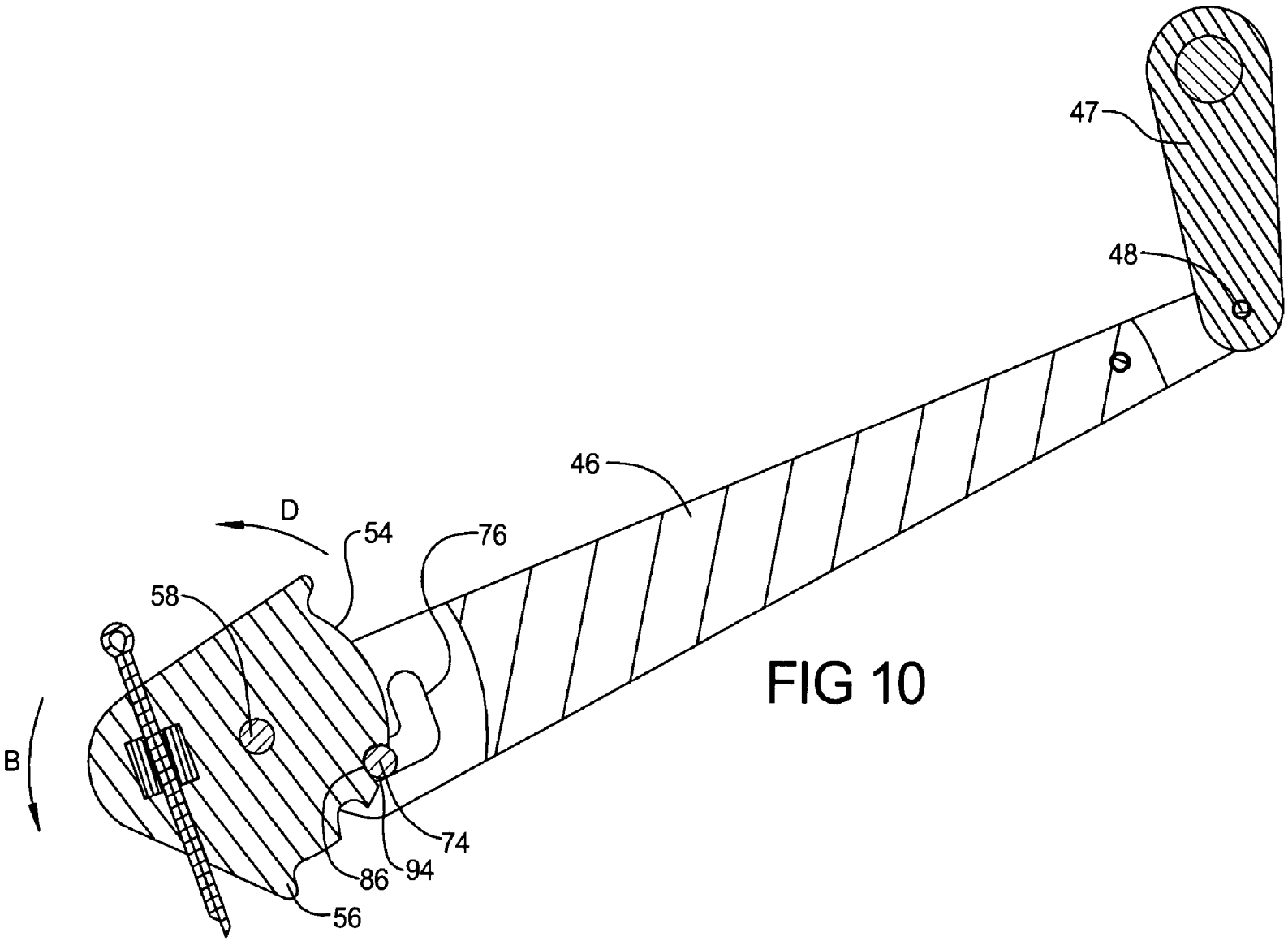
FIG. 10 is a cross sectional side elevational view of the detent mechanism in a first rotational stop position.

Referring generally to FIG. 10, as hand lever 18 is manually rotated in the direction of arc B, drive rod 30 and sector assembly 44 rotate to initiate extension of leg rest assembly 16 from the retracted position to the first locking position shown. Rotation of sector assembly 44 results in rotation of incline link 46 about pivot pin 58. Pin 74 is released from contact with first cam 84 and translates about peripheral edge 54 of sector plates 52, 53 and compressible element 56. When locking recess 86 is encountered, biasing elements 80, 81 bias pin 74 into seating engagement within locking recess 86. Pin 74 is temporarily "locked" within locking recess 86, increasing the resistance to further rotation of drive rod 30. At locking recess 86, leg rest assembly 16 is positioned in a first position which is approximately one-third extended. The compressive resistance provided by the relatively softer material of compressible element 56 compared to a metal material of pin 74 reduces a ratcheting sound as pin 74 engages within locking recess 86. Incline link 46 and link connector 47 rotate approximately 40 degrees relative to each other between the stowed position of FIG. 5A and the first locked position of FIG. 10. Pin 74 is maintained within first leg 94 of L-shaped aperture 76 during the transition between the stowed and first lock positions.

Figure 11:
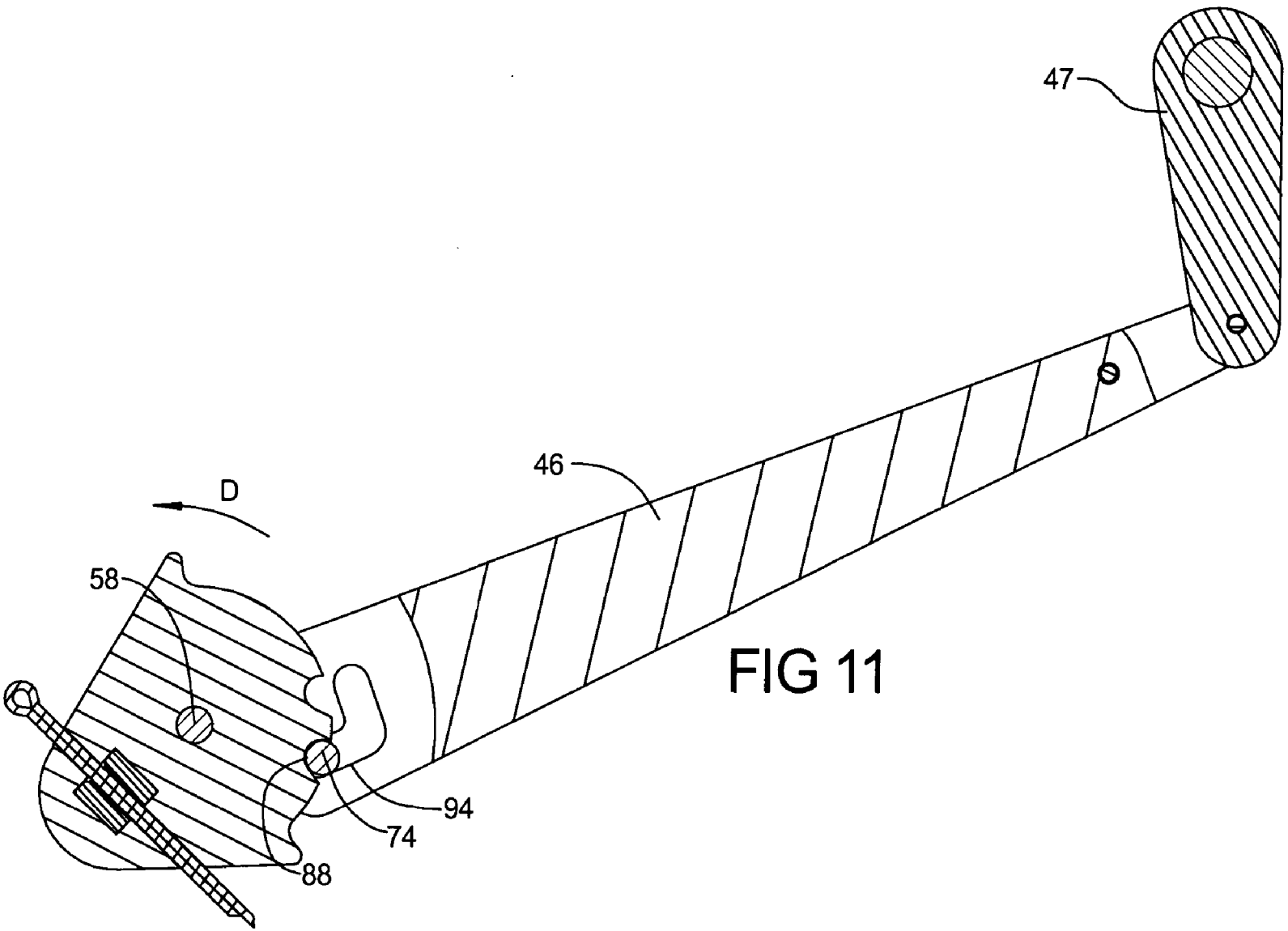
FIG. 11 is a cross sectional side elevational view of the detent mechanism in a second rotational stop position.

Referring next to FIG. 11, the leverage produced by rotation of hand lever 18 to rotate drive rod 30 is necessary to ratchet pin 74 out of locking recess 86. The biasing force of biasing elements 80, 81 do not significantly affect the leverage required to rotate drive rod 30 and is easily overcome. Pin 74 ratchets out of locking recess 86 and rotates due to contact with compressible element 56 as it travels about peripheral edge 54. Compressible element 56 provides sufficient friction to induce rotation of pin 74 which prevents metal on metal sliding between pin 74 and peripheral edge 54. Pin 74 does not significantly elastically deflect compressible element 56 as pin 74 travels about peripheral edge 54. When the next locking recess, locking recess 88 is encountered, biasing elements 80, 81 provide sufficient bias force to bias pin 74 to seat within locking recess 88. Pin 74 is temporarily "locked" within locking recess 88, locking recess 88 increasing the resistance to rotation of drive rod 30. At locking recess 88, leg rest assembly 16 is positioned in an intermediate position which is approximately two-thirds extended. Similar to entry into locking recess 86, the softer material of compressible element 56 extending into locking recess 88 reduces a ratcheting sound as pin 74 ratchets into and engages within locking recess 88.

Figure 12:
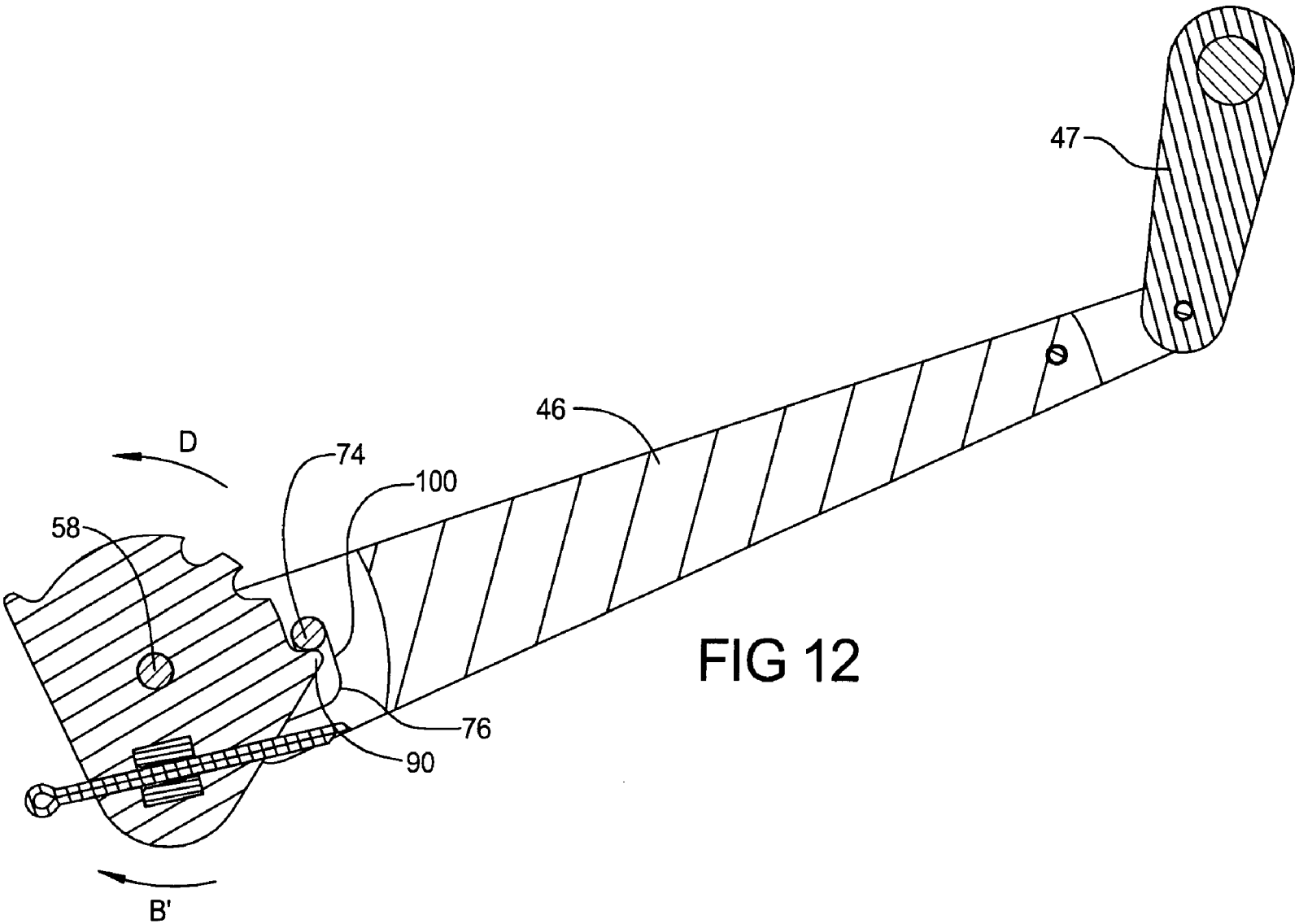
FIG. 12 is a cross sectional side elevational view of the detent mechanism in a third or fully extended rotational stop position.

Referring now to FIG. 12, after further overcoming the biasing force of biasing elements 80, 81, still further rotation of drive rod 30 translates pin 74 out of locking recess 88. Translation of pin 74 continues until pin 74 engages second cam 90. When pin 74 engages second cam 90, leg rest assembly 16 is positioned in a third or fully extended position. In the fully extended position, second cam 90 urges pin 74 forwardly and upwardly (as viewed in FIG. 12) into a second leg 100 of L-shaped aperture 76. In this manner, pin 74 disengages from peripheral edge 54 of sector plates 52, 53 such that counter-rotation of drive rod 30 in rotation direction arc B' is not inhibited by pin 74 engaging locking recesses 86 or 88 of peripheral edge 54. From any of the first or second intermediate positions of leg rest assembly 16, or the fully extended position shown, subsequent clockwise rotation about arc B' of hand lever 18 and drive rod 30 acts to return leg rest assembly 16 towards the fully retracted position. As leg rest assembly 16 returns toward the fully retracted position, sector assembly 44 rotates relative to incline link 46, and pin 74 engages first cam 84 to reset the pin 74 position into first leg 94. Biasing elements 80, 81 urge pin 74 into re-engagement within the first leg 94 of L-shaped aperture 76. In this manner, detent mechanism 42 is reset.

According to one preferred embodiment of the invention, compressible element 56 is a rubber material having approximately an 80 durometer hardness. In alternate embodiments, compressible element 56 is a silicon rubber or a polymeric material such as nylon, or the like. Compressible element 56 is provided from elastically compressible material to provide at least two functional improvements. A first improvement is the elimination of the need for a lubricant between pin 74 and sector plates 52, 53. This eliminates cost and time of a lubrication manufacturing step and precludes the possibility of loss of lubricant occurring during later use of chair 10. A second improvement is the noise reduction achieved using a compressible material between pin 74 and the metal material of pin 74, particularly proximate to locking recesses 86 and 88. The overall sound level generated during operation of chair 10 due to actuation mechanism 12 is therefore reduced.

Compressible element 56 can also be extended beyond peripheral edge 54 of each sector plate 52, 53 by an extension dimension of approximately 0.15 cm (0.06 in). The extension dimension is normally provided in each of recesses 86 and 88. The value of the extension dimension can vary at the discretion of the designer and is based on the compressibility of the material selected for compressible element 56. The extension dimension is beneficial if the material of sector plates 52, 53 are metal, which could prevent rotation of pin 74 or induce a ratcheting noise when pin 74 engages within locking recess 86 or 88.

A multiple position leg rest mechanism of the present invention provides several advantages. By positioning a compressible material element between sector plates that control a leg rest assembly rotation position, a pin engages the compressible material element and limits the noise generated when locked positions of the mechanism are reached. The compressible material element also eliminates a need for lubricant which would be required if the pin and the sector plates are both made of metal. The sector plates can also be made of a polymeric material, further reducing the noise of the mechanism. Biasing elements ensure the pin continuously contacts the peripheral edge of the sector plates, which also therefore ensure the pin engages in recesses of the sector plates positioned to provide locked positions of a leg rest assembly.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. In an actuation mechanism having a drive rod, a leg rest mechanism for releasably positioning a leg rest in each of a retracted position, an extended position, and at least one intermediate position, the leg rest mechanism comprising:

a pair of sector plates coupled to the drive rod for co-rotation therewith, each of the sector plates having a peripheral edge and at least one locking recess;

an elastically compressible element interposed between the sector plates and at least partially extending into the locking recess;

a rotatably mounted pin operable to rotate during travel about the peripheral edge of the sector plates; and a biasing element operable to bias the pin into engagement within the locking recess;

wherein the pin partially compresses the compressible element during engagement of the pin within the locking recess of the sector plates.

2. The leg rest positioning mechanism of claim 1, further comprising:

a front support shaft; and an incline link coupling the front support shaft to the drive rod, the incline link including:

a first end;

a pivot pin extending through each of the first end, the pair of sector plates and the elastically compressible element; and a second end operably coupled to the front support shaft;

wherein the pair of sector plates are oppositely disposed about the incline link and rotatably supported to the incline link by the pivot pin.

3. The leg rest positioning mechanism of claim 2, wherein the incline link further comprises an L-shaped aperture positioned proximate the pivot pin, the rotatably mounted pin being slidably received in the L-shaped aperture when the rotatably mounted pin operably engages the peripheral edge of the sector plates.

4. The leg rest positioning mechanism of claim 3, wherein each of the sector plates further comprise:

a first cam;

a second cam; and a first locking recess created between the first and second cams;

wherein the sector plates are alignable having the first cams alignable with each other, the second cams alignable with each other, and the first one of the at least one locking recesses aligned with each other.

5. The leg rest positioning mechanism of claim 4, further comprising:

a first leg of the L-shaped aperture wherein the first cam operably positions the rotatably mounted pin into the first leg when the leg rest is in a retracted position;

a second leg of the L-shaped aperture wherein the second cam positions the rotatably mounted pin into the second leg when the leg rest is in a fully extended position; and an intermediate position of the leg rest wherein the rotatably mounted pin operably engages the first locking recess.

6. The leg rest positioning mechanism of claim 2, wherein the biasing element comprises a pair of springs disposed on opposed sides of the incline link, each of the springs connected to both the rotatably mounted pin and the pivot pin and operable to bias the rotatably mounted pin toward the pivot pin.

7. The leg rest positioning mechanism of claim 2, further comprising a connecting link rotatably extending from the second end of the incline link, the connecting link operable to rotatably couple the incline link to the front support shaft.

8. The leg rest positioning mechanism of claim 7, further comprising a U-shaped pin operable to rotatably connect the connecting link and the incline link.

9. The leg rest positioning mechanism of claim 1, wherein each of the sector plates and the compressible element further comprise an aperture adapted to engageably receive the drive rod, the aperture defining a square-shape operable to secure the sector plates and the compressible element to the drive rod for co-rotation therewith.

10. The leg rest positioning mechanism of claim 1, wherein the peripheral edge further comprises:

a first locking recess wherein the rotatably mounted pin operably engages the first locking recess when the leg rest assembly is approximately one-third extended; and a second locking recess wherein the rotatably mounted pin operably engages the second locking recess when the leg rest assembly is approximately two-thirds extended.

11. The leg rest positioning mechanism of claim 1, wherein each of the sector plates comprises a square-shaped aperture formed therethrough for receiving the drive rod, the drive rod having a square-shaped cross section.

12. The leg rest positioning mechanism of claim 1, wherein the sector assembly further comprises a retaining element for securing at least the compressible element to the drive rod.

13. The leg rest positioning mechanism of claim 1, wherein the elastically compressible element comprises a rubber material.

14. A furniture member leg rest mechanism, comprising;

a rotatable drive rod;

a pair of sector plates coupled to the drive rod for co-rotation therewith, each of the sector plates having a peripheral edge;

an elastically compressible element interposed between the sector plates;

a pin adapted to engage the peripheral edge of the sector plates;

a pivot pin operable to rotate during engagement of the pin along the peripheral edge of the sector plates, the pivot pin insertable through each of the sector plates and the elastically compressible element; and a biasing element operable to bias the pin into engagement with the peripheral edge;

wherein the pin is induced to frictionally engage with the compressible element to reduce an operating noise of the leg rest mechanism.

15. The leg rest mechanism of claim 13, wherein the peripheral edge of each of the sector plates further comprises:

a first cam section;

a second cam section; and a recess created between the first and second cam sections;

wherein the pin is operable to temporarily engage each of the first and second cam sections and the recess.

16. The leg rest mechanism of claim 15, wherein the elastically compressible element comprises a rubber material.

17. The leg rest mechanism of claim 16, wherein the rubber material of the elastically compressible element comprises an 80 durometer hardness.

18. The leg rest mechanism of claim 15, further comprising a standout portion of the elastically compressible element extending beyond at least the recess, the standout portion compressible by contact with the pin.

19. The leg rest mechanism of claim 14, wherein the elastically compressible element comprises a polymeric material.

20. The leg rest mechanism of claim 14, further comprising:

a support shaft spatially separated from the drive rod; and an incline link, including:

a first end, the pivot pin extending through the first end; and a second end operably coupled to the support shaft;

wherein the pair of sector plates are disposed on opposite sides of the incline link and the incline link is rotatably supported on the pivot pin.

21. The leg rest mechanism of claim 20, wherein the biasing element comprises a pair of biasing elements connecting the pin to the pivot pin, the biasing elements operable to bias the pin toward the pivot pin.

22. A furniture member leg rest mechanism, comprising;

a drive rod;

a leg rest assembly coupled to the drive rod for extension by rotation of the drive rod;

a spring assisted toggle assembly operable to bias the leg rest assembly in each of a retracted position and a fully extended position;

a pair of sector plates coupled to the drive rod for co-rotation therewith, each of the sector plates having a peripheral edge including at least one recess;

an elastically compressible element interposed between the sector plates and extending beyond the recess of the sector plates;

a pin extendable through the sector plates and operable to rotate in response to engagement with the peripheral edge of the sector plates; and a biasing element operable to bias the pin into engagement within the recess created in the peripheral edge;

wherein the pin at least partially elastically compresses the compressible element during engagement of the pin with the recess.

23. The leg rest mechanism of claim 22, wherein the elastically compressible element comprises a rubber material.

24. The leg rest mechanism of claim 23, wherein the rubber material of the elastically compressible element comprises an 80 durometer hardness.

25. The leg rest mechanism of claim 22, further comprising a non-compressed standout portion of the elastically compressible element extending beyond the peripheral edge of each sector plate, the standout portion operable to assist inducement of rotation of the pin.

26. The leg rest mechanism of claim 22, wherein the elastically compressible element comprises a polymeric material.

27. The leg rest mechanism of claim 22, further comprising:

a support shaft spatially separated from the drive rod; and an incline link, including:

a first end including a pivot pin extending therethrough; and a second end operably coupled to the support shaft;

wherein the pair of sector plates are disposed on opposite sides of the incline link and rotatably supported on the pivot pin.

28. A method for operating a furniture member leg rest mechanism, the leg rest mechanism having a drive rod, a pair of sector plates each having a peripheral edge and at least one recess, an elastically compressible element, a pin and a biasing mechanism, the method comprising;

interposing the compressible element between the sector plates having at least a portion of the compressible element extending beyond an edge of the recess;

coupling the sector plates and the compressible element to the drive rod for co-rotation therewith;

biasing the pin into rotatable engagement with the peripheral edge using the biasing element;

rotating the drive rod until the pin slidably engages with the recess of the sector plates; and elastically compressing the portion of the compressible element with the pin to operably reduce an actuation noise of the leg rest mechanism.

29. The method of claim 28, further comprising further rotating the drive rod until the pin engages a second recess of the sector plates to operably lock the leg rest mechanism in an intermediate position.

30. The method of claim 29, further comprising extending a portion of the compressible element beyond the peripheral edge to operably induce rotation of the pin.

31. The method of claim 28, further comprising creating a rectangular-shaped aperture in each of the sector plates and the compressible element to operably receive a rectangular-shape cross section of the drive rod.

32. The method of claim 28, further comprising pinning an assembly including the sector plates and the compressible element to the drive rod.

33. The method of claim 28, further comprising coupling the drive rod to a support shaft.

* * * * *